US010271584B2

(12) United States Patent
Ward et al.

(10) Patent No.: US 10,271,584 B2
(45) Date of Patent: Apr. 30, 2019

(54) BRASSIERE ADAPTED FOR PRACTICING SPORTS

(71) Applicant: HANES OPERATIONS EUROPE SAS, Rueil-Malmaison (FR)

(72) Inventors: Daniel Graham Ward, Cambridgeshire (GB); Alan John Cucknell, Cambridgeshire (GB); Robert Scadding Moir, Cambridgeshire (GB); Michael Murphy, Norwich (GB)

(73) Assignee: Hanes Operations Europe SAS, Rueil-Malmaison (FR)

( * ) Notice: Subject to any disclaimer, the term of this patent is extended or adjusted under 35 U.S.C. 154(b) by 109 days.

(21) Appl. No.: 15/519,830

(22) PCT Filed: Oct. 14, 2015

(86) PCT No.: PCT/IB2015/057889
§ 371 (c)(1),
(2) Date: Apr. 17, 2017

(87) PCT Pub. No.: WO2016/059578
PCT Pub. Date: Apr. 21, 2016

(65) Prior Publication Data

US 2017/0245556 A1 Aug. 31, 2017

(30) Foreign Application Priority Data

Oct. 17, 2014 (FR) ..... 14 60041

(51) Int. Cl.
*A41C 3/00* (2006.01)

(52) U.S. Cl.
CPC ..... *A41C 3/0057* (2013.01); *A41C 3/0021* (2013.01); *A41C 3/0028* (2013.01)

(58) Field of Classification Search
CPC .... A41C 3/0057; A41C 3/0021; A41C 3/0028
(Continued)

(56) References Cited

U.S. PATENT DOCUMENTS 3,890,978 A 6/1975 Nobbs
5,662,512 A * 9/1997 Cohen ..... A41C 3/00 2/44

(Continued)

FOREIGN PATENT DOCUMENTS

AU 487908 B2 1/1977
CN 1642449 A 7/2005

(Continued)

OTHER PUBLICATIONS

Chinese Office Action in Chinese Application No. 201580056477.4, dated Jul. 6, 2018, 15 pages.

(Continued)

*Primary Examiner* — Gloria M Hale
(74) *Attorney, Agent, or Firm* — Fish & Richardson P.C.

(57) ABSTRACT

The invention relates to a brassiere (1) with reinforced support adapted for practicing sports and in particular of the type comprising a front part (2*a*) comprising two cups (3) for covering the bust (4) of a user (5), a dorsal fixation band (6) which is basically connected to the outer edge (7) of each of the cups (3), and a pair of straps (8) for running over the shoulders (9) of the user (5), which brassiere (1) is characterized in that the front part (2) comprises at least: a central anchoring structure (10) to which the straps (8) are attached and towards which these straps (8) converge; a lower support band (11) extending under the cups (3) approximately from an outer edge (7) to the other edge of these cups (3), a central support band (12) extending between the cups (3) from the lower support band (11) toward the central anchoring structure (10); and two lateral support bands (13) extending laterally from the side of the outer edges (7) of the cups (3) at least from the lower support band (11) to the central anchoring structure (10) towards which they converge; and in that the central anchoring structure (10) and the lower (11), central (12) and lateral (13) support bands form (Continued)

an inextensible support framework in order to be adjusted to the bust (4) in order to keep it approximately in place when practicing of sports.

20 Claims, 5 Drawing Sheets

(58) Field of Classification Search
USPC ..... 450/86
See application file for complete search history.

(56) References Cited

U.S. PATENT DOCUMENTS 6,110,007 A 8/2000 Rittmann
7,666,058 B2 * 2/2010 Smith ..... A41C 3/0064 450/20
7,850,508 B2 * 12/2010 Pitarelli ..... A41C 3/0064 450/85
2003/0013379 A1 1/2003 Henz
2006/0252346 A1 11/2006 Reinisch
2013/0065486 A1 3/2013 Hjorth

FOREIGN PATENT DOCUMENTS

CN 101495005 A 7/2009
FR 2945182 A 9/2011

OTHER PUBLICATIONS

PCT International Preliminary Report on Patentability, PCT/IB2015/057889, dated Apr. 27, 2017, 7 pages.
PCT International Search Report and Written Opinion of the International Searching Authority, PCT/IB2015/057889, Feb. 8, 2016, 11 pages.

* cited by examiner

BRASSIERE ADAPTED FOR PRACTICING SPORTS

This disclosure relates to a brassiere with reinforced support adapted for practicing sports.

Basically, two types of brassiere adapted for sports are known, namely, the compressive brassiere and the encapsulation brassiere.

The compressive brassiere comprises a front part, generally in the form of a band which compresses the bust in order to limit its movements and oscillations.

This type of brassiere generally does not have straps, which has the advantage of freeing the constraints exerted on the shoulders while limiting movements and oscillations.

However, this type of brassiere is perceived as uncomfortable by the users. Moreover, by compressing the bust, this type of brassiere can damage the bust.

The encapsulation brassiere comprises a front part comprising: two cups for surrounding each breast and thus acting independently on the movements of each breast, a dorsal fixation band which is generally connected to the outer edge of each of the cups, and a pair of straps for connecting the front part to the dorsal fixation band, running over the shoulders of the user.

This type of brassiere does not compress the bust and respects the health of the bust. Nevertheless, the support given by this type of brassiere is based substantially on:

- the straps, intended to support the bust upward;
- the cups, intended to contain the bust; and
- the back, intended to draw the cups to the rear, which creates a more or less strong compression on the bust as a function of the tightness.

The result of such a configuration is that the shoulders, the back and the lateral sides of the user are greatly strained during its use. Furthermore, the efficiency of the support is not optimized since some of these zones, when they are strained during the movements of the body, have relatively significant amplitudes of movement.

The present disclosure has the goal of solving all or part of the pre-cited disadvantages and in particular of improving the support of the bust while improving the comfort of the user.

This goal of the disclosure is achieved with a brassiere adapted for sports of the type comprising a front part comprising two cups for covering the bust of the user, a dorsal fixation band which is basically connected to the outer edge of each of the cups, and a pair of straps for passing over the shoulders of the user, which brassiere is characterized in that the front part comprises at least:

- a central anchoring structure to which the straps are attached and towards which these straps converge;
- a lower support band extending under the cups, basically from an outer edge to the other edge of these cups;
- a central support band extending between the cups from the lower support band to the central anchoring structure; and
- two lateral support bands extending laterally from the side of the outer edges of the cups, at least from the lower support band to the central anchoring structure towards which they converge;

and that the central anchoring structure and the lower, central and lateral support bands form an inextensible support frame designed to be adjusted on the bust in such a manner as to support it basically in place when engaging in sports.

The phrase "converge towards the central anchoring structure" denotes that the straps or the lateral support bands are directed and tend toward a common point carried by this central anchoring structure.

The fact that such a brassiere provided with a central anchoring structure to which the straps and the lateral support bands are connected and converge at the same time, themselves connected to the lower support band, permits the constraints exerted on the brassiere for supporting the bust at the level of a central support point of the body situated at the level of the sternum and of the vertebral column of the user to be concentrated and anchored. In such a configuration the shoulders and the lateral sides are then relieved at least partially and in a relatively significant manner the constraints associated with the supporting of the bust.

Moreover, the sternum, on which the central anchoring structure rests due to the configuration of the brassiere itself, and the vertebral column to which the sternum is connected by the skeleton of the body each present relatively weak movements when the body is in movement. This is basically due to the fact that the support point is situated on a zone, namely the sternum, which has the tendency to present not much fat on the body, which is connected to the skeleton by the ribs. The stresses are thus better absorbed by the bust of the user and better distributed equally due to her skeleton.

Moreover, a support integral with the bust resting on the shoulders is not very comfortable for the user, all the more when the straps running across them are located in the middle, even below the shoulders, that is to say when they are removed from her neck. With such a configuration, these straps of the brassiere are automatically placed and supported by the central anchoring structure at the high level of the shoulders in the vicinity of the user's neck, consequently improving her comfort.

Furthermore, this comfort is also reinforced by the fact that the central anchoring structure absorbs a part of the strains of supporting the brassiere, which also participates in reducing the intensity of the constraints exerted by the bust on the shoulders and the back.

Moreover, due to the fact that this central anchoring structure is centered at the level of the bust and connected on the one hand to the straps of the brassiere arranged above this central anchoring structure, in particular around the neck, and on the other hand to the lateral support bands arranged below the central anchoring structure, this allows the maintaining in place of this central anchoring structure in spite of the movements of the user, which is particularly advantageous in the framework of practicing sports.

Such a brassiere also permits limiting the movements and oscillations of the bust. In fact:

- on the one hand the lower support band and the lateral support bands, each being inextensible and extending approximately transversely relative to the user's body allow the reduction of the approximately vertical oscillations of the bust, namely, from top to bottom and from bottom to top.
- On the other hand the central and lateral support bands, each being inextensible and extending approximately transversely allow the reduction of the approximately transversal oscillations of the bust, namely, laterally from right to left and from left to right while isolating the bust from the movements of the arms.

The cups themselves ensure a natural support without compressing the bust in order to ensure the comfort of the user while limiting the frontally oriented oscillations from front to rear from the rear to the front. These cups are arranged in such a manner that they do not comprise any intermediate framework but the only framework of the brassiere is formed by the support framework located around the cups.

Furthermore, the word "adjusted" denotes that the support framework is in contact with and is supported against the user's body at the level of her bust, that is to say, pressed against her.

According to an advantageous technical characteristic the central anchoring structure is intended to be placed at the level of the sternal fork of the user.

This permits in particular a good distribution of the strains of supporting the bust at the level of the skeleton of the user. Moreover, such a zone is located at the top of the manubrium of the sternum, which allows the straps of the brassiere to be supported at the level of the shoulders around the neck of the user, thus improving the comfort of the brassiere.

According to a particular characteristic the central anchoring structure, the lower, central and/or lateral support bands are supple or flexible. This allows the comfort of the user to be improved Advantageously, the brassiere also comprises at least one inextensible, upper support band extending above the cups, approximately from one lateral support band to the other one.

This allows the reduction of the vertical oscillations of the bust, namely, from top to bottom and from bottom to top to be improved even more relative to the body of the user concomitantly with the lateral and lower support bands. In fact, in this manner each of the breasts is surrounded by the inextensible support framework formed in this manner and adjusted relative to the bust.

According to particular technical characteristics the central support band extends from the lower support band to the upper support band and up to the central anchoring structure towards which it then converges.

Furthermore, such a brassiere can have different sizes in order to adapt as a function of the person. However, in order to better adapt to the shape of each of the users and to improve the adjusting of the support framework, the central support band, the lateral support bands and/or the straps can be regulated in length in particular by regulating means.

In a complementary or alternative manner, it can be provided that the straps also comprise regulating means for being adapted in length.

According to a particular configuration the pair of straps basically form a ring for surrounding the user's neck.

The pair of straps is advantageously connected to the dorsal fixation band at the level of a back part of the brassiere.

The strap pair forms a "Y" at the level of the back part. Such a configuration allows in particular the straps to be supported at the level of the shoulders around the neck of the user, improving her comfort.

In a particular configuration the central anchoring structure forms a fixation means which can be moved between a locked position and a loosened position.

In fact, since the lower, central and later support bands are inextensible and since these support bands are arranged to be each adjusted to the body, that is to say, not too tight nor too loose, such a characteristic allows the loosening of at least a part of the straps and/or support bands among themselves so as to facilitate their usage. This is in particular the case when the user puts on such a brassiere or takes it off.

The dorsal fixation band also advantageously comprises a closure. This also facilitates the putting in place or the removal of the brassiere by the user.

According to an advantageous technical configuration the straps and the back fixation band are elastic so as to improve the user's comfort while ensuring her a freedom of movement when playing sports.

Other characteristics and advantages of the disclosure will be apparent from a reading of the following description, given sole by way of example, with reference made to the attached figures, in which.

In all of these figures identical or analogous references designate identical or analogous parts or units.

Figure 1:
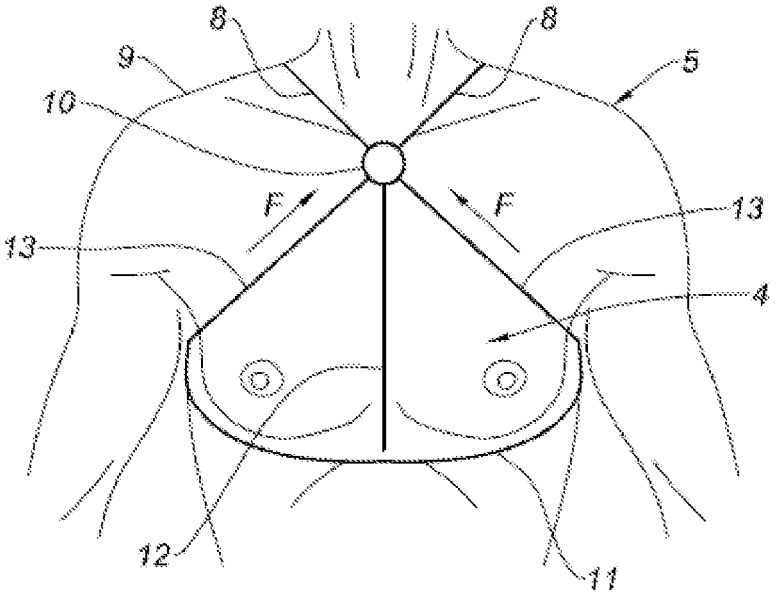
FIGS. 1 and 2 show basic views of a brassiere according to an embodiment of the disclosure worn by a user, which views correspond respectively to view of a front part and of a back part of this brassiere.
Figure 2:
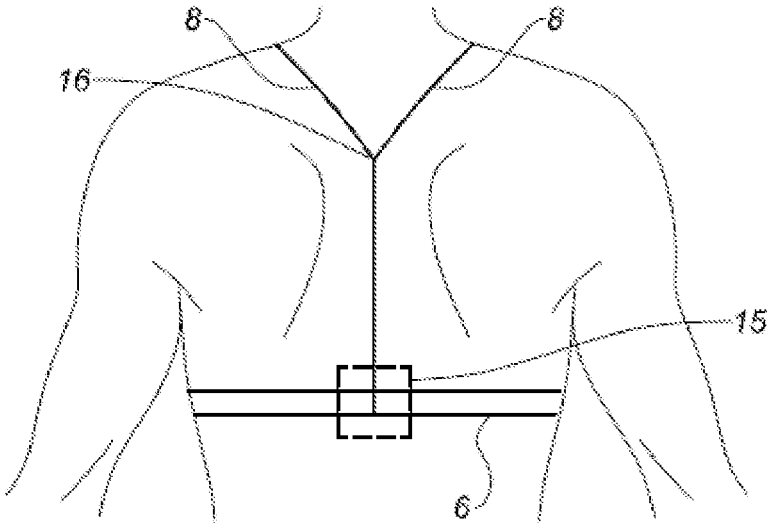

FIGS. 1 and 2 show basic views of a brassiere 1 on a bust 4 of a user 5, in particular views of a front part 2*a* and of a back part 2*b* of this brassiere 1.

In the basic views certain elements of the brassiere 1 such as the cups 3 designed to surround each breast are not shown in these two FIGS. 1 and 2.

The brassiere 1 comprises a pair of straps 8 and these straps are intended to run on the one shoulder and on the other shoulder of the shoulders 9 of the user 5.

Furthermore, FIG. 1 shows in particular an inextensible support framework 10, 11, 12, 13 comprising:

- a central anchoring structure 10 to which the straps 8 are attached and towards which these straps 8 converge, that is, they are directed and tend toward a common point carried by the central anchoring structure 10;
- a lower support band 11 extending under the cups 3, that is, under the breasts of the user in the worn or dressed position, transversely relative to the bust 4 of the user 5, in particular from an outer edge 7 (not shown here) to the other one of these cups 3 (see in particular FIG. 3);
- a central support band 12 extends between the cups 3 or between the breasts in the worn position of the brassiere as is visible in FIG. 1, and the support band extends in particular from the lower support band 11 up to the central anchoring structure 10 towards which it converges; and
- two lateral support bands 13 extending laterally from the side of the outer edges 7 of the cups 3, that is, from each outer side of the breasts in the worn position from the lower support band 11 to the central anchoring structure 10 towards which they converge.

In such a configuration the straps 8, the central support band 12 and the lateral support bands 13 converge together toward a common point carried by the central anchoring structure 10.

The lower support band 11 forms an inextensible connection line between the central support bands 12 and lateral ones 13 under the cups 2, that is, under the breasts. In this manner the bust is supported by the support framework, whose stresses are applied at the level of the central anchoring structure.

The central anchoring structure 10 forms a junction at least between the lateral support bands 13 and the support around the neck ensured by the straps 8.

Moreover, the convergence of the straps 8 and of the lateral support bands 13 has the result that the central anchoring structure 10 is placed in a position carried by the user at the level of her sternum, that is, a region of the body where the fatty tissue has little fat.

Such a characteristic is especially advantageous due to the fact that when the user 5 performs a sport, the tissues covering the sternum are not very mobile relative to the skeleton in comparison to the tissues of other regions such as the lateral flanks at the level of the sides of the user 5, or at the level of the upper part of her bust 4. As a consequence, the stresses of supporting the brassiere 1 are applied in particular on this zone of which the tissues covering it are not very fatty and are distributed on the skeleton of the user from the sternum to the vertebral column passing via the ribs.

In this embodiment the inextensible support framework 10, 11, 12, 13 as well as the strap pair 8 are arranged in such a manner that in the worn position the central anchoring structure 10 is placed supported against the sternal fork of the user.

Furthermore, the central anchoring structure 10, the lower support band 11, the central support band 12 and the lateral support bands 13 forming the support framework are each inextensible and designed to be adjusted on the bust 4 in such a manner as to support it basically in place when engaging in sports, wherein it is understood that the oscillations are limited.

In fact, the lower support band 11 extends transversely relative to the bust 4 and just below it and the lateral support bands 13 extends partially transversely to just above the bust 4, which bust 4 is surrounded vertically by these lower bands 11 and lateral bands 13 which are adjusted against it, which allows a reduction of the vertical component of the oscillations of the bust, namely from high to low or from low to high.

Furthermore, the central support band 12 extends vertically relative to the bust and between the breasts and the lateral support bands 13 extend partially vertically on both sides of the bust 4, wherein the bust 4 is surrounded transversally by the central support bands 12 and the lateral support bands 13 which are adjusted against it, which allows a reduction of a transversal component of the oscillations of the bust 4, namely, from left to right or from right to left. This also allows the movement of the arms to be isolated from that of the bust 4.

The word "adjusted" denotes that the support framework 10, 11, 12, 13 is designed to be in contact with and supported on the skin of the user. The central support band 12 is typically designed to be positioned flat against the user's skin between her breasts. In the contrary case the transversal oscillations of the bust, namely, from right to left and from left to right would not be isolated in an optimal manner.

Moreover, the adjustment of the central support band flat against the bust contributes to isolating the breasts. In fact, in the contrary case where the central support band 12 is loosened, it appears that the breasts are coupled together in their transversal movements. In other words, one of the breasts in its transversal movement entrains the other one, which amplifies the transversal oscillations of the bust and favors the appearance of pain for the user due to mutual shocks between her breasts.

Moreover, the convergence of the lateral support bands 13 toward and up to the central anchoring structure 10 also has the result that the lateral support bands 13 create a tractive strain F upward and towards the center of the bust 4. This allows its support to be ensured without compressing the bust 4, which improves the user's comfort. This is even more advantageous due to the fact that the central anchoring structure 10 is supported against the sternal fork of the user. In fact, such a zone seems to be a good compromise since in the case in which this central anchoring structure 10 would be placed too low, this would comprise the function ensured by the lateral support bands 13, in particular the function consisting of limiting the movements of the bust 4 toward the arm.

As FIG. 2 shows in particular, the straps 8 extend from the central anchoring structure 10 of the front part 2 to the dorsal fixation band 6 at the level of the back part 2*b* of the brassiere 1. In particular, the straps 8 run around the neck of the user passing over her shoulders at their high level and are joined at the back of the user at the level of the junction 16 in order to form a unified part 8' of straps up to the dorsal fixation band 6, thus forming a "Y".

Just as the central anchoring structure 10, which is located supported against the sternal fork, the fact that the junction 16 is situated in the back above the dorsal fixation band 6 tends to keep the strap pair 8 in the immediate vicinity of the neck, that is, at the level at the height of the shoulders. In this manner the comfort is reinforced, freeing the bottom and the area of the shoulders of the user.

Furthermore, the dorsal fixation band 6 comprises a closure 15 allowing the attaching of two ends of the dorsal fixation band 6 and to which a lower end of the unified part 8' of the straps 8 is attached. Alternatively or as a complement, a closure can also be positioned at the level of the unified part 8' of the straps 8.

The straps are preferably designed to be supported against the back between the shoulder blades of the user, and preferably the unified part 8' of the straps 8 is designed to run along her vertebral column.

Just like the straps 8, the dorsal fixation band 6 is preferably elastic to improve the user's comfort. The dorsal fixation band 6 can extend on the frontal part of the brassiere 1 in such a manner that it runs adjacent to, for example, the lower support band 11, which is inextensible. This contributes in particular to adjusting the support framework 10, 11, 12, 13 against the bust.

As concerns the central anchoring structure 10, it can be rigid or non-rigid but it preferably has a certain flexibility and lightness in order to prove the comfort of the user.

Figure 3:
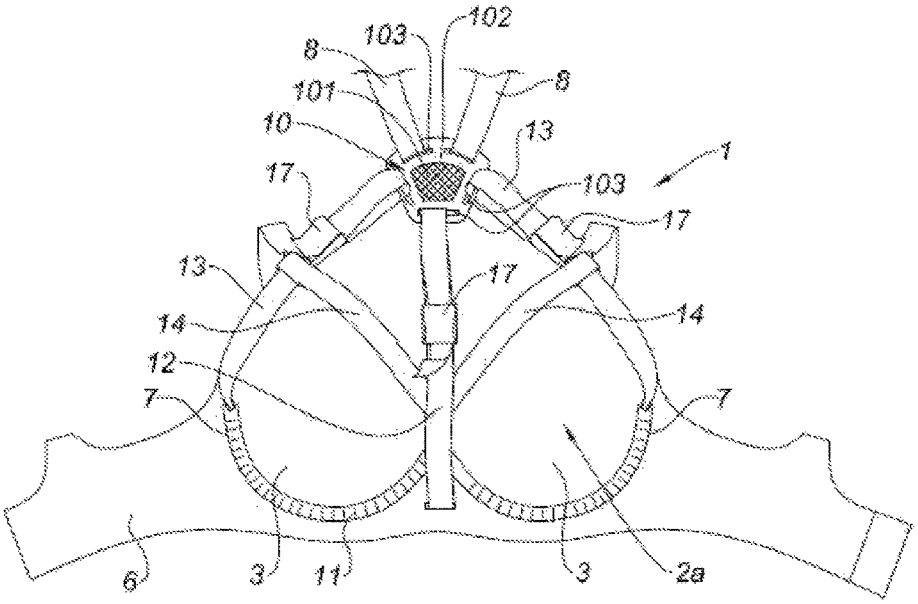
FIG. 3 shows a view of a brassiere according to another embodiment of the disclosure.

FIG. 3 shows a brassiere according to an embodiment of the disclosure.

In the same manner as is shown in the FIGS. 1 and 2, the brassiere has a pair of cups 3 designed to surround each breast, a dorsal fixation band 6 which is connected to the outer edge 7 of each of the cups 3, and a pair of straps 8 (not shown in detail here) that are to be run over the shoulders 9 of the user 5. The brassiere 1 furthermore comprises in accordance with the disclosure:

a central anchoring structure 10 to which the straps 8 are attached and towards which these straps 8 converge;

a lower support band 11 extending under the cups 3 from an outer edge 7 to the other edge of these cups 3;

a central support band 12 extending between the cups 3 from the lower support band 11 to the central anchoring structure 10; and two lateral support bands 13 extending laterally from the side of the outer edges 7 of the cups 3 from the lower support band 11 to the central anchoring structure 10 towards which they converge;

the central anchoring structure 10 and the lower 11, central 12 and lateral 13 support bands forming an inextensible support frame designed to be adjusted on the bust 4 in such a manner as to support it basically in place when engaging in sports.

Furthermore, in this particular embodiment the brassiere 1 comprises an inextensible upper support band 14 integral with the support framework and extending above each of the cups 3 from one lateral support band 13 to the other one.

The central support band 12 extends from the lower support band 11 to the central anchoring structure passing by the upper support band 14 to which it is connected.

The zones situated between the bust 4 and the central anchoring structure 10 and delimited in particular by the central 12, lateral 13 and upper 14 support bands can each have an intermediate wall like a piece of knitting connecting these support bands 12, 13, 14 to each other. In this case this intermediate wall can be either inextensible in order to participate in the support of the bust 4 or can have a certain elasticity in order to adjust to the shape of said bust 4.

In order to best adapt the brassiere to the shape of the user 5, the central 12 support bands and lateral support bands can be regulated in length and each one comprises a regulating device 17 provided for this purpose.

The central anchoring structure 10 here comprises an inner part 101 open at least partly in order to permit the skin against which it rests in the position of wearing to breathe and the inner part 101 is open here by means of a plurality of orifices emptying on both sides of the central anchoring structure 10.

An outer part 102 of the central anchoring structure extends over a circumference of its inner part 101 and has notches 103 formed to receive the straps and central 12 and lateral 13 support bands 12.

To this end two distinct upper notches 103 are designed for each of the straps 8, two lateral notches 103 are designed to receive the lateral support bands 13 and a lower notch 103 is designed to receive the central support band 12.

The central 12 and lateral 13 support bands each have a free end on the side of the central anchoring structure 10 designed to traverse the notches 103 and return to the regulating device 17, thus forming a loop.

Each regulating device 17 comprises a mobile stop notch between a position in which the support band is unlocked in order to permit the regulation in length and a locked position in which the stop notch blocks any sliding of the associated support band in order to save the length selected by the user 5.

The central 12, lateral 13 and upper 14 support bands here are bands comprising polyester fibers woven with a particular mesh in such a manner that they are inextensible.

As concerns the lower band 11, it delimits a lower part of the cups 3, and the inextensible nature of this lower band 11 is conferred to it by a seam adapted along this lower band 11.

In other words, the word "inextensible" denotes that it is possible to use either a material whose intrinsic characteristics imparts its inextensible nature to it, or a combination of materials of which at least one can have inextensible nature but whose assemblage is such that the structure of the assemblage itself confers its inextensible nature to the support band.

The dorsal fixation band 6 is extensible and elastic in order to improve the comfort of the user 5.

The embodiments shown in FIGS. 4-10 show variants of brassieres 1 in conformity with the disclosure.

Whatever the variant that is shown, each brassiere 1 has a pair of cups 3 designed to surround each breast, a dorsal fixation band 6 which is connected to the outer edge 7 of each of the cups 3, and a pair of straps 8 (not shown in detail here) that are to be run over the shoulders 9 of the user 5. The brassiere 1 furthermore comprises in accordance with the disclosure:

a central anchoring structure 10 to which the straps 8 are attached and towards which these straps 8 converge;

a lower support band 11 extending under the cups 3 from an outer edge 7 to the other edge of these cups 3;

a central support band 12 extending between the cups 3 from the lower support band 11 to the central anchoring structure 10; and two lateral support bands 13 extending laterally from the side of the outer edges 7 of the cups 3 from the lower support band 11 to the central anchoring structure 10 towards which they converge;

the central anchoring structure 10 and the lower 11, central 12 and lateral 13 support bands forming an inextensible support frame designed to be adjusted on the bust 4 in such a manner as to support it basically in place when engaging in sports.

Figure 4A:
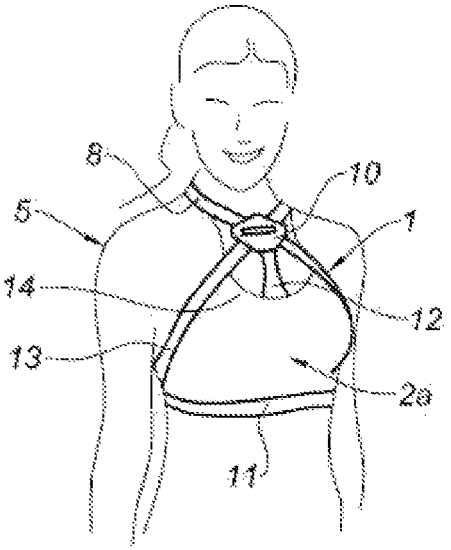
FIGS. 4A and 4B show sketches of a front part and of a back part of a brassiere according to another embodiment of the invention.
Figure 4B:
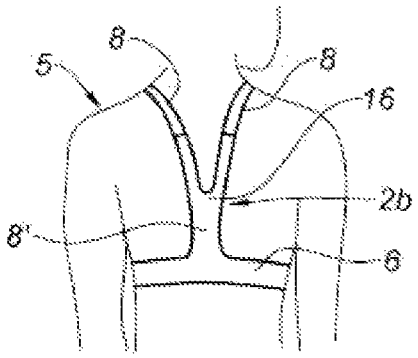

In the embodiment shown in FIGS. 4A and 4B the brassiere comprises a tissue extending frontally from a lateral support band 13 to another one and superposed on cups 3 and on the central support band 12, improving the looks of the brassiere. As a function of the configuration used, the upper edge of this tissue can form an upper, inextensible support band 14.

Furthermore, in this embodiment the lower support band 11 runs along the dorsal fixation band 6.

At the level of the back part 2*b* of the brassiere the straps 8 run around the neck of the user passing over her shoulders at their high level and are joined at the back of the user at the level of the junction 16 in order to form a unified part 8' of straps up to the dorsal fixation band 6, thus forming a "Y".

However, the dorsal fixation band 6 does not comprise closure 15 here. The dorsal fixation band 6, the unified part 8' of the straps 8 as well as said straps 8 are formed, at least in the vicinity of the junction 16, as one piece, preferably a monoblock, in order to avoid the presence of supplementary seams that might irritate the skin when practicing a sport. This monoblock piece of tissue is preferably elastic in order to improve the comfort of the user.

Figure 5A:
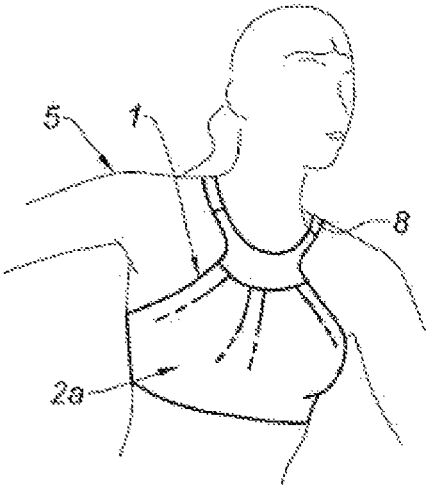
FIGS. 5A, 5B and 5C show sketches of a front part, of a back part and of a closure of a pair of straps of a brassiere according to another embodiment of the disclosure.
Figure 5B:
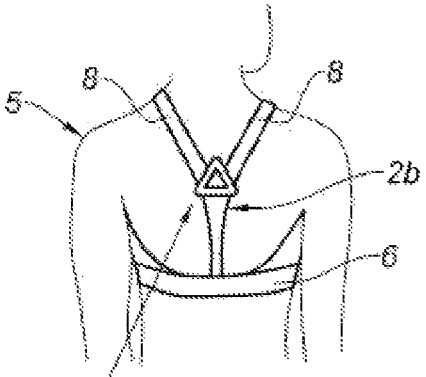
Figure 5C:
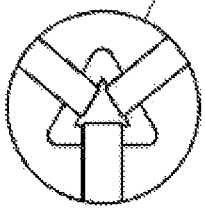

Referring to the FIGS. 5A, 5B and 5C, the front part 2*a* of the brassiere 1 has a knitted piece extending frontally and delimited by the lateral 13 and lower 11 support bands that it covers and by the central anchoring structure.

At the level of the back part 2*b* of the brassiere 1 the junction 16 between the unified part 8' and the two straps 8 surrounding the neck of the user 5 is ensured by an intermediate device in the form of a triangle integrated on the one hand with the unified part 8' at the level of the base of the triangle and on the other hand each of the two straps at the level of the two upper sides of this triangle.

Figure 6B:
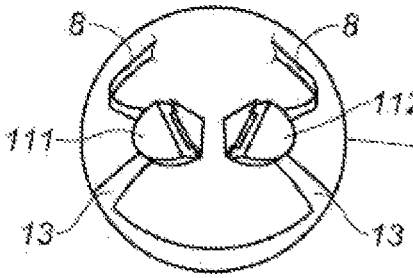
FIGS. 6A and 6B show sketches of a front part and of a central anchoring structure of a brassiere according to another embodiment of the disclosure.
Figure 6A:
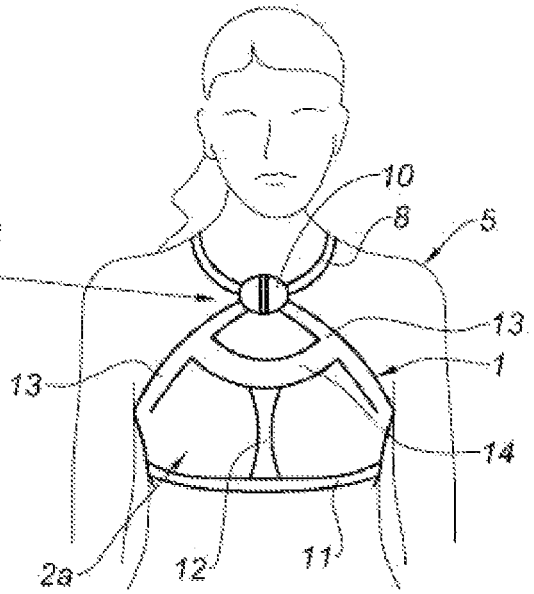

Referring to the FIGS. 6A and 6B, they show brassiere 1 comprising at the level of its front part 2*a* and upper support band 14 extending from one lateral support band 13 to the other one, forming a circular arc whose center is situated approximately at the level of the central anchoring structure 10.

Moreover, the brassiere 1 comprises a central support band 12 extending from the lower support band 11 toward the central anchoring structure 10 up to the upper support band 14.

Advantageously, as is the case here, the central anchoring structure 10 forms a movable fixation means which can be moved between a locked position (see FIG. 6A) and a loosened position (see FIG. 6B).

In particular, the central anchoring structure 10 can be divided into two parts 111, 112, and each of these movable parts 111, 112 is connected to one of the straps 8 and to one of the lateral support bands 13 situated on the same side relative to the bust 4.

Alternatively, the central anchoring structure 10 can be divided into two parts with one of the parts connected to the two straps 8 and the other part connected to at least to the two lateral support bands 13 and also to the central support band 12 (not shown).

This allows the user to facilitate the managing of the brassiere in order to position it on herself or to remove it.

This fixation means can be formed, for example, by clip(s), hooks or any other means permitting the movable parts 111, 112 to be assembled in a movable manner between these locked and loosened positions. These movable parts 111, 112 can each form, for example, a male part or a female part designed to cooperate with one another.

Figure 7:
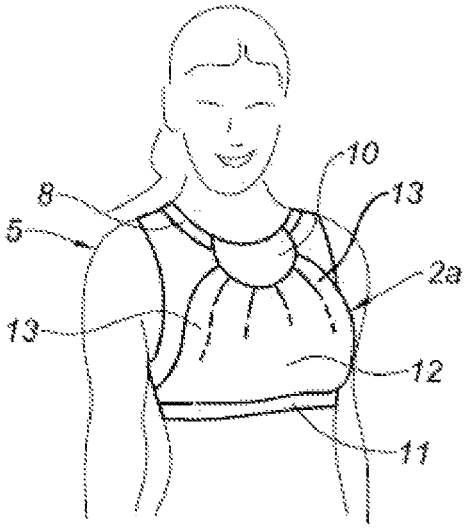
FIG. 7 shows a sketch of a front part of a brassiere according to another embodiment of the disclosure.

FIG. 7 shows another embodiment in which in particular one of the straps 8 and one of the lateral support bands 13 situated on the same side relative to the bust 4 are connected by an elastic tissue in order to improve the looks of the brassiere and the comfort of the user.

Figure 8:
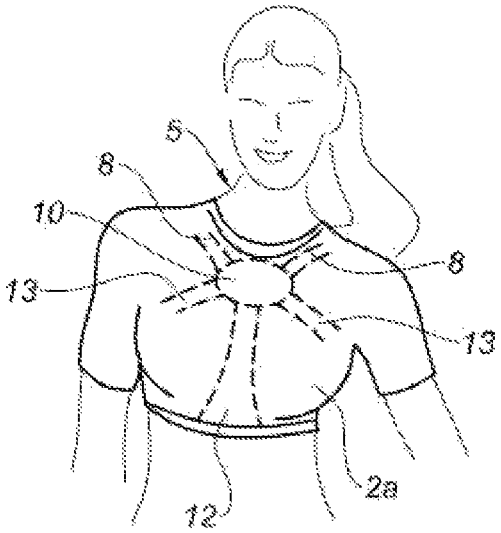
FIG. 8 shows a sketch of a front part of a brassiere according to another embodiment of the disclosure.

FIG. 8 shows an embodiment in which the brassiere 1 is integrated with an article of clothing for the upper part of the body and hiding it.

Figure 9A:
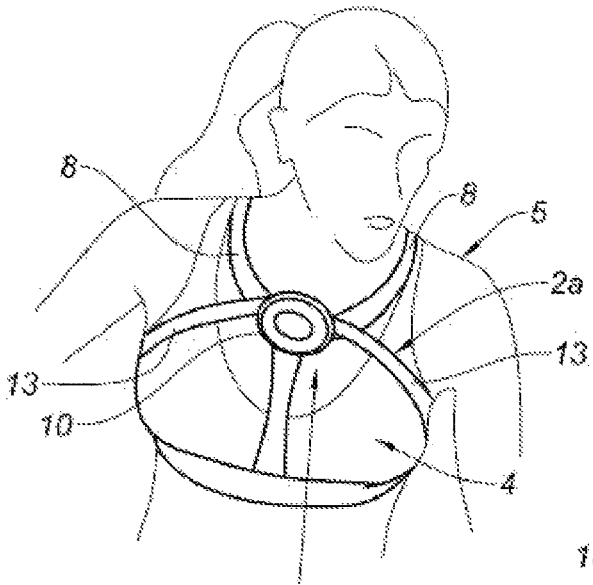
FIGS. 9A and 9B show sketches of a front part and of a central anchoring structure of a brassiere according to another embodiment of the disclosure.
Figure 9B:
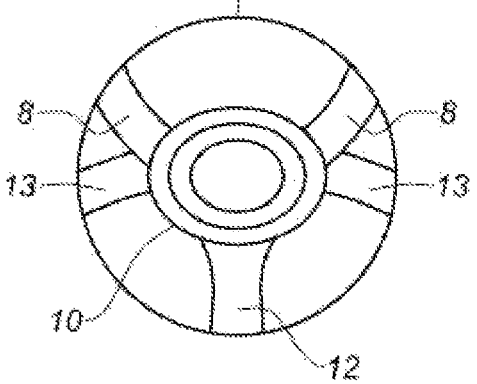

FIGS. 9A and 9B show a brassiere 1 partially integrated to an article of clothing for the upper part of the body and whose central anchoring structure 10 has an approximately annular shape to which the straps 8 and the lateral support bands 13 and the central support bands 12 are attached. This annular shape is formed at least on its outer part by silicone, which improves the comfort, adjusting and suppleness.

In a certain configuration the anchoring structure can be integrated with at least one sensor, a memory and/or a calculator.

Figure 10:
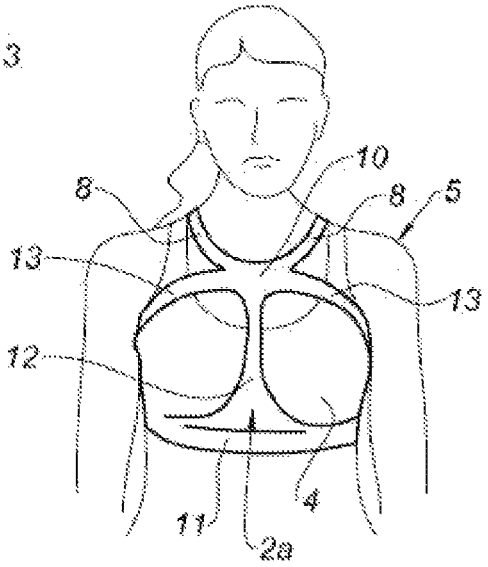
FIG. 10 shows a sketch of a front part of a brassiere according to another embodiment of the disclosure.

On the contrary, as shown in FIG. 10, the central anchoring structure 10 can be formed in a monoblock or in one piece with the straps 8, the lateral support bands 13 and optionally, as illustrated here, with the central support band 12.

In this manner the central anchoring structure 10 is not too thick and lightens the brassiere.

Whatever the embodiment, the inextensible support framework is preferably flexible in such a manner as to improve the comfort of the user and improve the adjusting of the support framework as a function of the exact shape of the user.

These lower 11, central 12 and lateral 13 support bands can be of different natures.

For example, all or part of these bands can be composed of at least one uniquely textile material such as a knitted material without elastane (polyamide, polyester . . . ). In this case preferably one of these materials used is either 100% polyamide, 100% polyester, etc.).

In another configuration all or part of these bands are formed by an application of resin(s) on at least one textile material in order to "block" this textile material, that is, to inhibit the extensions of the textile material. In this case the textile material can be, in a non-limiting manner, of the knit or jersey type.

In another complementary or alternative configuration each of the bands can be formed entirely or in part by at least one complex of thermally adhered material(s).

The disclosure was described above by way of example. It is understood that a person skilled in the art is able to realize different embodiments of the disclosure without leaving the scope of the disclosure.

The invention claimed is:

1. A brassiere adapted for sports, the brassiere comprising:

a front part comprising two cups for covering a bust of a user, a dorsal fixation band connected to an outer edge of each of the cups, and a pair of straps for running over shoulders of the user, wherein the front part comprises:

a central anchoring structure to which the straps are attached and towards which the straps converge;

a lower support band extending under the cups approximately between the outer edges of the cups;

a central support band extending between the cups from the lower support band toward the central anchoring structure; and two lateral support bands extending laterally from sides of the outer edges of the cups at least from the lower support band to the central anchoring structure towards which the two lateral support bands converge;

wherein the central anchoring structure and the lower, central, and lateral support bands form an inextensible support framework configured to be adjustable on the bust to support the bust in place.

2. The brassiere according to claim 1, wherein the central anchoring structure is configured to be positioned on the user at the level of a sternal fork of the user.

3. The brassiere according to claim 1, wherein at least one of the central anchoring structure, the lower support band, the central support band, or the two lateral support bands are flexible.

4. The brassiere according to claim 1, comprising at least one inextensible, upper support band extending above the cups approximately from one of the two lateral support bands to the other one of the two lateral support bands.

5. The brassiere according to claim 4, wherein the central support band extends from the lower support band to the upper support band.

6. The brassiere according to claim 1, wherein the central support band extends from the lower support band to the central anchoring structure.

7. The brassiere according to claim 1, wherein at least one of the central support band, the two lateral support bands or the straps are configured to be adjustable in length.

8. The brassiere according to claim 1, characterized in that the pair of straps basically form a ring for surrounding the neck of the user.

9. The brassiere according to claim 1, wherein the pair of straps is connected to the dorsal fixation band at the level of a back part of the brassiere.

10. The brassiere according to claim 9, wherein the strap pair forms a Y-shape at the level of the back part.

11. The brassiere according to claim 1, wherein the central anchoring structure forms a movable fixation means between a locked position and a loosened position.

12. The brassiere according to claim 1, wherein the dorsal fixation band comprises a closure.

13. The brassiere according to claim 1, wherein the central anchoring structure is configured to be positioned between the cups.

14. The brassiere according to claim 13, wherein the central support band extends from the lower support band to the central anchoring structure.

15. The brassiere according to claim 13, wherein at least one of the central anchoring structure, the lower support band, the central support band, or the two lateral support bands are flexible.

16. The brassiere according to claim 2, wherein at least one of the central anchoring structure, the lower support band, the central support band, or the two lateral support bands are flexible.

17. The brassiere according to claim 2, wherein the central support band extends from the lower support band to the central anchoring structure.

18. The brassiere according to claim 3, comprising at least one inextensible, upper support band extending above the cups approximately between the two lateral support bands.

19. The brassiere according to claim 2, wherein the central anchoring structure forms a movable fixation means between a locked position and a loosened position.

20. The brassiere according to claim 6, wherein the central anchoring structure forms a movable fixation means between a locked position and a loosened position.

* * * * *